US008297876B2

(12) United States Patent
Wagner

(10) Patent No.: US 8,297,876 B2
(45) Date of Patent: Oct. 30, 2012

(54) ROAD BUILDING MACHINE FOR MILLING ROAD SURFACES

(75) Inventor: Jens Wagner, Boppard (DE)

(73) Assignee: Bomag GmbH, Boppard (DE)

( * ) Notice: Subject to any disclaimer, the term of this patent is extended or adjusted under 35 U.S.C. 154(b) by 47 days.

(21) Appl. No.: 13/039,041

(22) Filed: Mar. 2, 2011

(65) Prior Publication Data

US 2011/0217120 A1 Sep. 8, 2011

(30) Foreign Application Priority Data

Mar. 2, 2010 (DE) ..... 10 2010 009 834
Aug. 18, 2010 (DE) ..... 10 2010 034 662

(51) Int. Cl.
*E01C 19/05* (2006.01)

(52) U.S. Cl. ..... 404/85; 404/94; 180/209

(58) Field of Classification Search ..... 404/83, 404/85, 94; 180/209
See application file for complete search history.

(56) References Cited

U.S. PATENT DOCUMENTS

| | | | | |
|---|---|---|---|---|
| 3,511,394 | A * | 5/1970 | Cox | 414/565 |
| 3,971,594 | A * | 7/1976 | Wirtgen | 299/39.6 |
| 4,966,418 | A | 10/1990 | Wirtgen | |
| 6,106,073 | A * | 8/2000 | Simons et al. | 299/39.6 |
| 6,705,798 | B2 * | 3/2004 | Dubay et al. | 404/84.05 |
| 7,331,636 | B2 * | 2/2008 | Troudt et al. | 299/39.6 |

FOREIGN PATENT DOCUMENTS

| | | |
|---|---|---|
| DE | 3903482 A1 | 8/1990 |
| DE | 196 31 042 C2 | 6/2000 |
| GB | 2151445 A | 7/1985 |

OTHER PUBLICATIONS

Related German Application Search Report (DE 10 2010 034 662.4, one of the priority applications).

* cited by examiner

*Primary Examiner* — Raymond W Addie
(74) *Attorney, Agent, or Firm* — Baker & Hostetler LLP

(57) ABSTRACT

A road building machine for road surface paving is provided. The machine comprises an automotive travelling mechanism with a steerable front axle of the undercarriage comprising at least one support wheel and two rear support wheels, a working device which is mounted in or on the machine frame and is approximately flush with said machine frame on one side, which is the so-called null side, a swivel unit having an articulation area formed by the machine frame and a swivel arm which carries the rear support wheel on the null side at its one end and is pivotably linked at its other end to the articulation area of the machine frame, with the swivel unit being arranged in the manner that it can be pivoted between an "outwardly pivoted position" in which the rear wheel which is on the null side is pivoted outwardly to an outer end position parallel to the longitudinal direction of the machine frame and an "inwardly pivoted position" in which the rear support wheel which is on the null side is inwardly pivoted to an inward end position which is parallel to the longitudinal direction of the machine frame, and a pivot gear which controls the adjustment of the swivel unit between the "outwardly pivoted position" and the "inwardly pivoted position" around a swivel axis.

18 Claims, 8 Drawing Sheets

ROAD BUILDING MACHINE FOR MILLING ROAD SURFACES

CROSS-REFERENCE TO RELATED APPLICATIONS

This application claims priority to foreign Patent Applications DE 10 2010 009 834.5, filed on Mar. 2, 2010, and DE 10 2010 034 662.4, filed on Aug. 18, 2010, the disclosures of which are incorporated herein by reference in their entirety.

FIELD OF THE INVENTION

The invention relates to a road building machine for milling road surfaces, especially a cold milling machine for road surface paving.

BACKGROUND OF THE INVENTION

Generic road building machines are known. In one known machine, the mill comprises an automotive travelling mechanism. A total of four support wheels, two at the front and two at the rear, are arranged on the automotive travelling mechanism, with embodiments with only one front support wheel being known. The front axle of the undercarriage is arranged to be steerable. Furthermore, a working device is present which is mounted in or on the machine frame and is approximately flush with the machine frame. The working device concerns a cylindrical milling drum in the case of a cold milling machine for example which is arranged in the rear region of the machine frame. Since the milling drum is arranged in the manner that it is virtually flush with a front side with the lateral edge of the machine frame, the machine is also capable of milling close to the edges since the working device can be moved directly past the edge. It is advantageous for a stable guidance of the machine however when the two rear support wheels enclose the milling drum along its rotational axis on both sides and are disposed at one level in the working direction of the mill. It is therefore also known to arrange the rear support wheel which is disposed on the null side laterally from the face side of the working device to the outside, so that it protrudes laterally beyond the machine frame. In order to enable milling that is near to an edge with one and the same mill and in order to achieve a stable guidance of the machine if milling close to the edge is not desired at the same time, the rear support wheel which is disposed on the null side can be arranged to be horizontally pivotable, so that it can be positioned, as required, in the inwardly or outwardly pivoted state.

It is known for this purpose to provide a swivel unit on the mill, comprising an articulation area formed by the machine frame and a swivel arm which carries the rear support wheel on the null side at its one end and is pivotably linked at its other end to the articulation area of the machine frame. The articulation area of the swivel unit designates the part of the machine frame in which the pivot bearing for the inwardly and outwardly pivotable swivel arm is arranged on the machine frame. This does not only relate to the direct contact area of the respective articulated connection, but rather also the portion of the machine frame adjacent to this area. The swivel unit is specifically arranged in the manner that it can be pivoted between an "outwardly pivoted position" in which the rear wheel which is on the null side is pivoted outwardly to an outer end position parallel to the longitudinal direction of the machine frame and an "inwardly pivoted position" in which the rear support wheel which is on the null side is inwardly pivoted to an inward end position which is parallel to the longitudinal direction of the machine frame. If milling close to the edge is desired or if the road building machine is to be as narrow as possible for transport purposes for example, the rear support wheel which is on the null side will thus be pivoted to the "inwardly pivoted position". It is alternatively also possible to outwardly pivot the support wheel to its "outwardly pivoted position" and thus improve the travelling properties of the road building machine for example.

In order to enable the integration of the pivoting of the pivot wheel especially well into the operation of the machine, it is further known to provide a pivot bearing which enables the automatic displacement of the pivot unit between the "outwardly pivoted position" and the "inwardly pivoted position". The pivoting axis usually extends vertically and the pivoting movement between the "inwardly pivoted position" and the "outwardly pivoted position" in a horizontal plane. One disadvantage of known pivot units is their continued need for much space which is principally caused by the arrangement of the gear in a horizontal plane. This causes problems to housing the pivot unit especially in compact road building machines, especially in the "inwardly pivoted position".

SUMMARY OF THE INVENTION

Embodiments of the present invention advantageously provide a road building machine, especially a cold milling machine, which enables the easy inward and outward pivoting of the rear support wheel which is disposed on the null side, functions reliably and requires little space at the same time.

The inventive pivot gear is a spatial gear with a thrust member which is adjustable in the vertical direction that comprises a deflection device which is arranged in the manner that it deflects the vertical movement of the thrust member to a horizontal inwardly and outwardly pivoting movement of the swivel arm. In contrast to pivot gears that were used up until now in generic road building machines which provide the arrangement of the gear in a horizontal plane, the embodiments of the invention pursue a completely new direction and uses a spatial gear, not a gear disposed in a plane. A spatial gear is characterized in respect of its definition in that member points of a least one gear member are able to perform a movement relative to at least one or other gear member. Although the sequence of movements of the individual gear members is thus not uniformly in a common plane, the use of a spatial gear offers considerable advantages, especially a substantially more compact arrangement of the entire pivot unit.

An important component of the pivot gear is the thrust member is adjustable in the vertical direction. The designation "vertical direction" relates to the direction of the thrust member in the installed state in a generic road building machine. It is principally relevant that the thrust member extends at a right angle in relation to the (horizontal) pivot plane of the swivel arm. The vertically adjustable thrust member is used in the end to introduce the drive power into the spatial gear which is required for the inward and outward pivoting process. The thrust member is connected for this purpose with a suitable drive unit which will be explained below in closer detail by reference to an example. The vertical adjusting movement of the thrust member which is driven by the drive unit can both be a lifting and a lowering movement along the vertical axis, depending on whether the inward or outward pivoting of the swivel arm is desired. In order to enable the vertical adjustability of the thrust member, a large number of specific embodiments are possible, e.g. by guiding the thrust member along a vertically extending guide axis.

A further important aspect of the pivot gear in accordance with embodiments of the invention is that the spatial gear comprises a deflection unit. The deflection unit is specifically used to deflect the vertical adjusting movement driven by the drive unit in such a way that the horizontally adjustable swivel arm can be pivoted from its "inwardly pivoted position" to its "outwardly pivoted position" and vice-versa. The deflection device thus deflects the vertical actuating force which is introduced via the thrust member into the spatial gear into a horizontal actuating force acting upon the swivel arm. The deflection device thus designates the part of the spatial gear which absorbs the vertical movement of the thrust member and thus triggers the horizontal movement of the swivel arm. For this purpose, a part of the deflection device is moved spatially and not only in one plane. It is thus not necessary in the pivot gear in accordance with embodiments of the invention to arrange all gear elements in a horizontal plane. The pivot gear can thus be arranged in a substantially more compact manner and can be integrated more easily in a road building machine, especially a cold milling machine.

The spatial pivot gear in accordance with embodiments of the invention thus converts the linear vertical movement of the thrust member into a horizontal pivoting movement at least about the swivel axis of the swivel arm. The spatial gear is thus preferably arranged as a coupling gear, with the coupler being arranged between the swivel arm and the thrust member.

The thrust member can be arranged in different ways. It is thus possible for example to provide a vertically arranged worm gear, on which the thrust member vertically moves up and down by the rotation of the worm gear. Alternatively, the thrust member can be guided along a vertically extended, especially bolt-like, axis, especially preferred along a pivot joint axis, with the drive unit being arranged in the vertical direction adjacent to the thrust member. Such linearly guided slides can be realized from a constructional viewpoint in various ways and are simultaneously characterized by high functional reliability. It is a common feature in all alternative embodiments in accordance with the invention that the slide is guided along a vertically extending thrust axis. The thrust axis designates the movement axis along which the slide can be adjusted vertically. The thrust axis relates to the respective central point of a horizontal section through the slide.

It is principally possible to interpose several intermediate members between the slide and the swivel arm. The deflection device can therefore also be arranged with several members. It is advantageous however that the deflection device is arranged as directly as possible between the slide and the pivot arm, especially directly. The direct linkage of the deflection device on the slide on the one hand and the swivel arm on the other hand allows an especially advantageous transmission of forces because the friction losses are especially low for example. The coupling of the deflection device on the slide and on the swivel arm for example preferably occurs by a suitable link joints, e.g. ball-and-socket joints.

The deflection device preferably specifically concerns a rigid and especially integral deflection member. Such a rigid and especially also integral gear member especially requires little maintenance for example. An especially efficient deflection of the vertical actuating force of the thrust member into a horizontal actuating force for pivoting the swivel arm is thus achieved at the same time. The deflection member can be arranged for example in a rod-shaped or cylindrical way, etc. Principally, such deflection members are preferable due to their simple configuration which extend at least in one direction in a straight line.

The rigid deflection member is linked on the one side to the slide by a first link joint, especially directly. At the other end a second link joint is present on the deflection member, via which the deflection member is linked to the pivot unit. In relation to the vertical thrust axis, the linkage of the rigid deflection member to the slide further preferably occurs in the manner that the longitudinal axis between the two link joints lies at an angle ($\beta$) of 0° to less than 90° in relation to the horizontal pivot plane of the swivel arm, with the smallest angle being determined in connection with this. It is further preferred, in some embodiments, that the first link joint, at a rectangular projection to the horizontal pivot plane, lies eccentrically in relation to the thrust axis, or not on but adjacent to the thrust axis. This is of predominant importance especially when the thrust axis of the thrust member and the pivot axis of the swivel arm are arranged coaxially according to a further preferred embodiment. This embodiment comes with the advantage that a pin which for example is mounted along the pivot axis between the linkage area and the swivel arm can be used simultaneously for guiding the thrust member. On the other side, the rigid deflection member of the deflection device is linked by a second link joint to the horizontally pivotable pivot unit. A vertical displacement of the thrust member thus results in a spatial change of position of the rigid deflection member of the deflection device, thus triggering a horizontal pivoting of the swivel arm as a result of its simultaneous linkage to the horizontally pivotable pivot unit and the vertically displaceable slide. This is especially also achieved due to the fact that both the swivel arm is forcibly guided in relation to the linkage area (pivotable in the horizontal plane) and the thrust member in relation to the guide of the thrust member (displaceable along the vertical axis), e.g. the link pin.

In order to further improve the relationship between the vertical actuating path of the thrust member to the resulting pivoting path or the gear ratio, the deflection device comprises in a further preferred embodiment a further deflection member linked to the thrust member, with the one deflection member being linked with its free end to the machine frame and the further deflection member with its free end to the swivel arm. The relevant feature of this embodiment is that the deflection device comprises two deflection members for each thrust member. One of the two deflection members acts between the thrust member and the machine frame, and the other of the two deflection members acts between the thrust member and the swivel arm.

Ideally, the two deflection members are structurally identical. In this way, the overall number of different parts required for the production of the road building machine in accordance with the invention can be reduced, which is an advantageous for example for the production costs and for ensuring the supply of spare parts.

In preferable embodiments, the swivel arm is arranged with several members and especially two members, comprising an inner arm and an outer arm. The inner arm of the swivel arm is linked to the machine frame in a horizontally pivotable manner. The outer arm is adjacent to the free end of the inner arm, on which the support wheel is mounted to the outside either indirectly or directly. The outer arm is horizontally pivotable in relation to the inner arm. As a result, there is a kinematic chain disposed in the horizontal plane in the sequence of machine frame, inner arm and outer arm. This embodiment allows that the swivel arm is foldable per se, or is also pivotable between the inner arm and outer arm. In order to enable the outward and inward pivoting of the outer arm in relation to the inner arm, a suitable gear is present in this embodiment, via which the pivoting of the outer arm in relation to the inner arm is controlled. This embodiment is advantageous in the respect that the swivel arm can be "inwardly folded" even in the horizontal plane, which considerably facilitates the adjustment of the swivel arm between the "inwardly pivoted position" and the "outwardly pivoted position".

Principally, the adjustment of the outer arm in relation to the inner arm can occur by means of a gear disposed in a horizontal plane for example. It is better in this case too for reasons of limited space to provide a spatial gear, especially with the principal configuration as explained above, by means of which the pivoting movement of the outer arm in relation to the inner arm is achieved. As a result, a further deflection device can be present for example which is arranged in the manner that it deflects the vertical movement of a thrust member adjustable in the vertical direction into a horizontal inward and outward pivoting movement of the outer arm in relation to the inner arm.

For this purpose, a slide is advantageously also present whose thrust axis extends coaxially in relation to the pivot axis between the inner arm and the outer arm. The spatial gear for pivoting the inner arm in relation to the machine frame and the spatial gear for pivoting the outer arm in relation to the inner arm are thus preferably arranged in a functionally similar manner. It is thus possible for example to use the same components for both spatial gears, which is also advantageous with respect to production costs etc.

In other preferable embodiments, the thrust axes of the provided slides and the pivot axes of the pivot device between the linkage area and the inner arm and between the inner arm and the outer arm are parallel with respect to one another. It is thus ensured on the one hand that the inner arm and the outer arm can be swiveled against one another and in relation to the machine frame in a common plane. On the other hand, the thrust axes of the slides extend orthogonally in relation to this plane so that an especially compact configuration can be achieved in particular.

It is principally possible to provide a drive unit for the spatial gear between the machine frame and the inner arm and a further separate drive unit for the spatial gear between the inner arm and the outer arm. This special configuration allows especially arranging the pivoting from inner arm to outer arm and from inner arm to machine frame independently from one another. A much simpler and thus preferred configuration will be obtained when the gear units between the inner arm and the outer arm and between the inner arm and the machine frame are not applied independent from one another but are rather functionally coupled with one another. A preferred point of attack for such a functional coupling is the respective slide for example (or the slide of the spatial gear between the linkage area and the inner arm and the slide of the spatial gear between the inner arm and the outer arm). A functional coupling shall be understood in this connection especially as an interconnection of the two slides in the manner that both slides can only be moved jointly together. The movement of the one slide automatically simultaneously also leads to a movement of the other slide. From a practical standpoint, such a functional coupling can be achieved in an especially favorable way with a connection element for example, especially an integral connecting web, between the two slides. Both slides are thus mechanically connected with one another by this connecting web. The relevant advantage of a functional coupling of the two slides is especially that the triggering of the two slides via a common thrust drive is enabled.

Principally, the drive unit of the gear or the thrust drive for the slide can be obtained in different ways. The thrust drive is arranged in the manner that it can adjust the slide upwardly and downwardly along its vertical thrust axis. A suitable thrust drive can be the respective worm gear for example, along which the slide is driven directly or indirectly via respective connecting elements, depending on the embodiment. In preferable embodiments, the thrust drive is arranged as a cylinder/piston unit, especially a hydraulic cylinder/piston unit. Road building machines and especially mills usually already have a hydraulic system, e.g. for driving the support wheels via respective hydraulic motors and/or for driving the working apparatus. If a thrust drive is provided in the form of a cylinder/piston unit, it is thus possible to connect the thrust drive to the hydraulic system that is usually provided in a road building machine and especially the mill. The production costs and maintenance expenditure can thus also be reduced for example.

The thrust drive is further mounted on the inner arm in certain preferable embodiments. Such a mounting is advantageous in the respect that a simultaneous mechanical transmission of the actuating force exerted by the thrust drive on the thrust member is achieved in an especially simple way on the respective slides of the spatial gear between the inner arm and the outer arm and between the inner arm and the machine frame. All transmitting elements such as a connecting web for the mechanical coupling of the two slides can be mounted jointly on the inner arm and are moved simultaneously with the same.

The inner arm is further arranged in an L-shaped manner in one preferable embodiment, with the L-shaped arrangement relating to the shape of the inner arm in the horizontal pivot plane of the swivel arm. The shorter leg of the L-shaped inner arm is advantageously linked to the machine frame in this embodiment, whereas the longer leg is linked to the outer arm. This embodiment has proven to be advantageous in the respect that it enables an especially compact linkage to the machine frame without having a negative influence on the pivoting path of the swivel arm.

The link joints of the deflection device as mentioned above can be varied in many ways. Ball-and-socket joints have proven especially suitable because they enable the spatial movement of the mutually connected links with respect to one another. Ball-and-socket joints are further especially sturdy and are comparatively simple in their arrangement. A ball-and-socket joint comprises a joint ball and a joint socket partly enclosing the same. It has proven to be advantageous in link joints of the deflection device, especially in the case that it is arranged as a rigid deflection member, to arrange the sockets in the deflection member and the corresponding joint balls in the opposite gear part such as the machine frame, the slide, the inner arm or the outer arm.

BRIEF DESCRIPTION OF THE DRAWINGS

The invention will be explained in closer detail by reference to schematic drawings, wherein.

DETAILED DESCRIPTION

Figure 1:
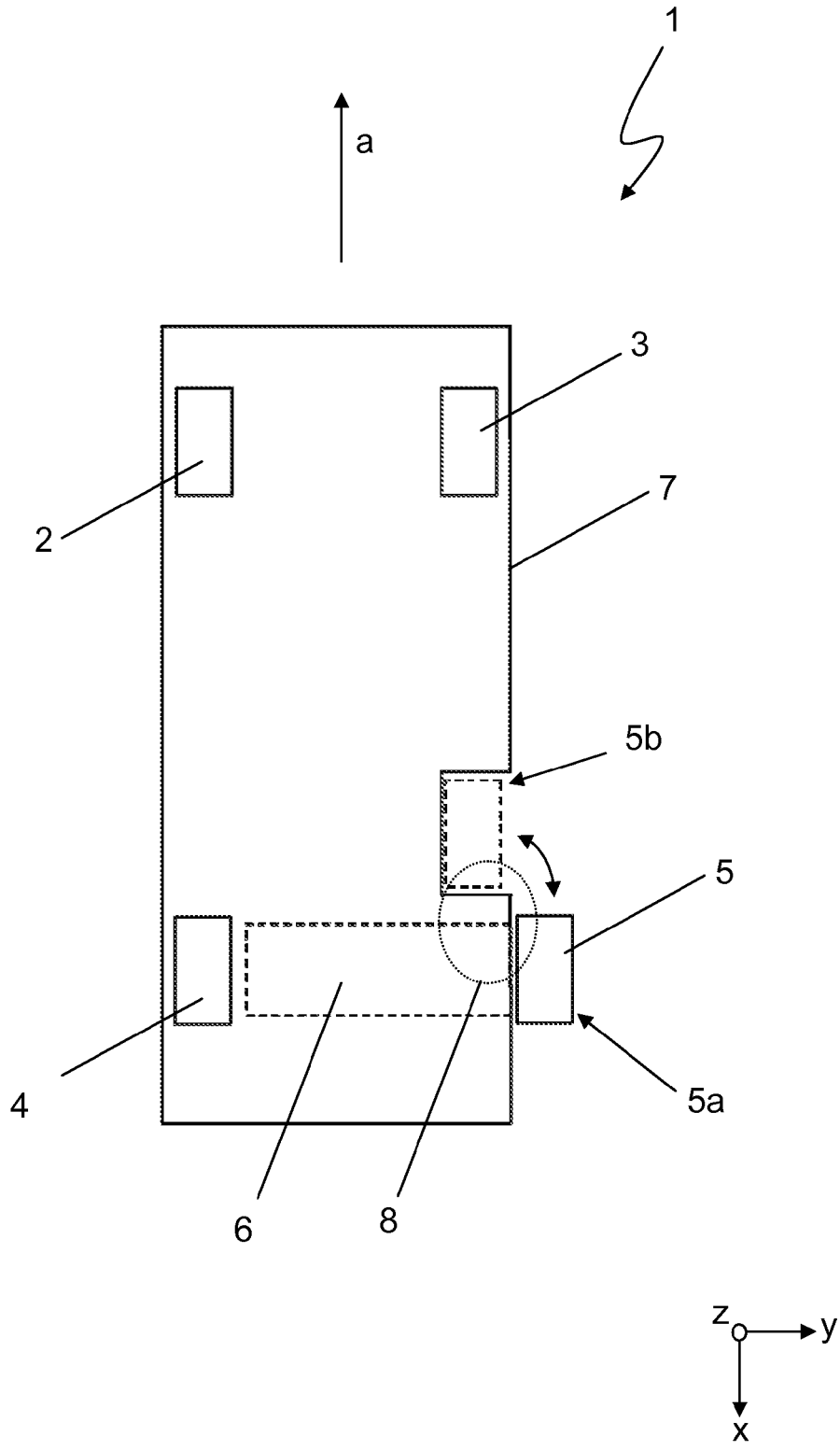
FIG. 1 shows a top view of a road building machine according to an embodiment of the present invention.

The same components are provided with the same reference numerals below. For reasons of clarity of the illustration, each component repeated in the drawings is not numbered again in each drawing.

The principal arrangement of the support wheels relative to the machine frame and to the working device is shown in FIG. 1. FIG. 1 shows a schematic top view of a road building machine, specifically a cold milling machine. The road building machine 1 accordingly comprises two front support wheels 2 and 3 and two rear support wheels 4 and 5. A working device 6 is further present which is virtually flush with the machine frame on one side (on the right side in FIG. 1). In the embodiment according to FIG. 1, the working device 6 specifically concerns a substantially cylindrical mill drum which is suitable for example for removing road surfaces made of concrete, asphalt or the like. The working device 6 is lowered for this purpose onto the surface to be processed and made to rotate. The road building machine 1 is moved in the direction of arrow a over the road surface. The direction of arrow a indicates in FIG. 1 and the following drawings the movement of the road building machine "in the forward direction".

FIG. 1 further shows that the support wheel 5 can be pivoted between an "outwardly pivoted position" 5*a* and an "inwardly pivoted position" 5*b*. The support wheel 5 can thus be pivoted from the outwardly pivoted position 5*a* as indicated in FIG. 1 in which it protrudes laterally beyond the machine frame to the position 5*b* where it is shown with the broken line in which it no longer protrudes laterally beyond the machine frame. In this way, the road building machine can be moved with the support wheel 5 to position 5*b* close to walls etc and milling close to the edge is possible on the side where the working device 6 is virtually flush with the machine frame. This side of the machine frame will be referred to subsequently as the null side 7. In order to pivot the support wheel 5, the road building machine comprises a pivoting unit with a pivot gear which is indicated in closer detail in FIGS. 2*a* to 4*b*. The position of this pivoting unit is indicated by the circle with the dotted line merely for rough orientation. During the inward and outward pivoting, the running direction of the swivelable support wheel 5 reverses in the embodiment as shown in FIG. 1. It is also possible that the support wheel 5 is arranged in the manner that its running direction is maintained in the positions 5*a* and 5*b*.

Figure 2A:
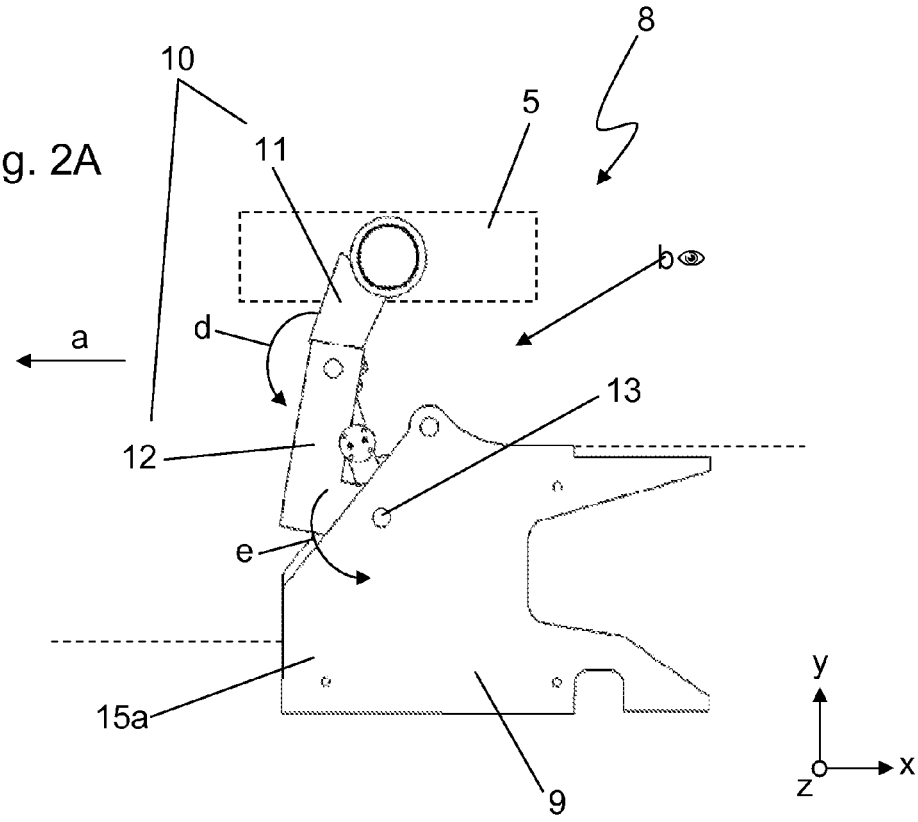
FIGS. 2A to 2D show various views of the pivot unit in the "outwardly pivoted position" according to an embodiment of the present invention.
Figure 2B:
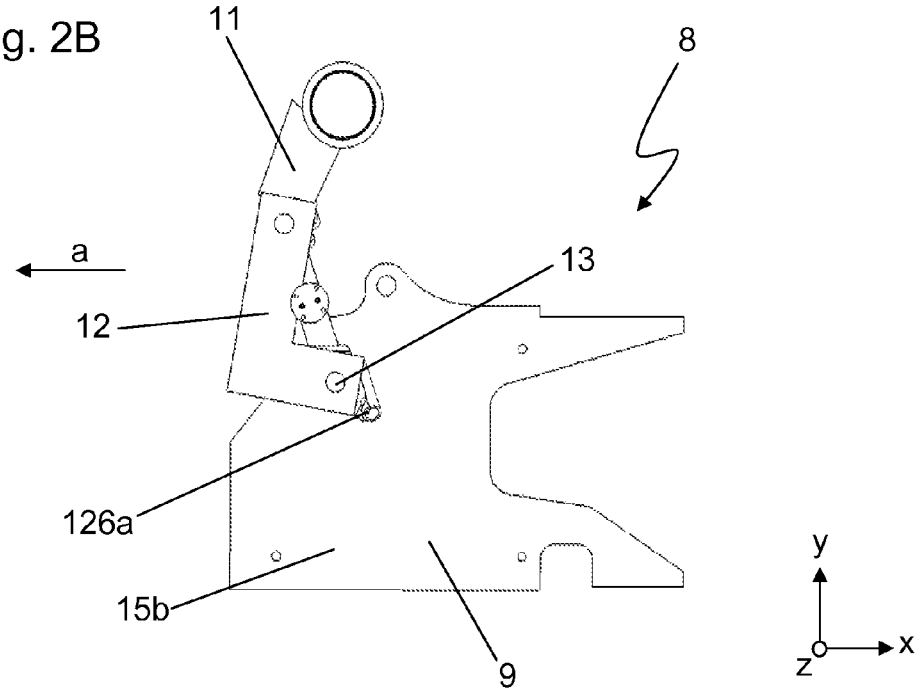
Figure 2C:
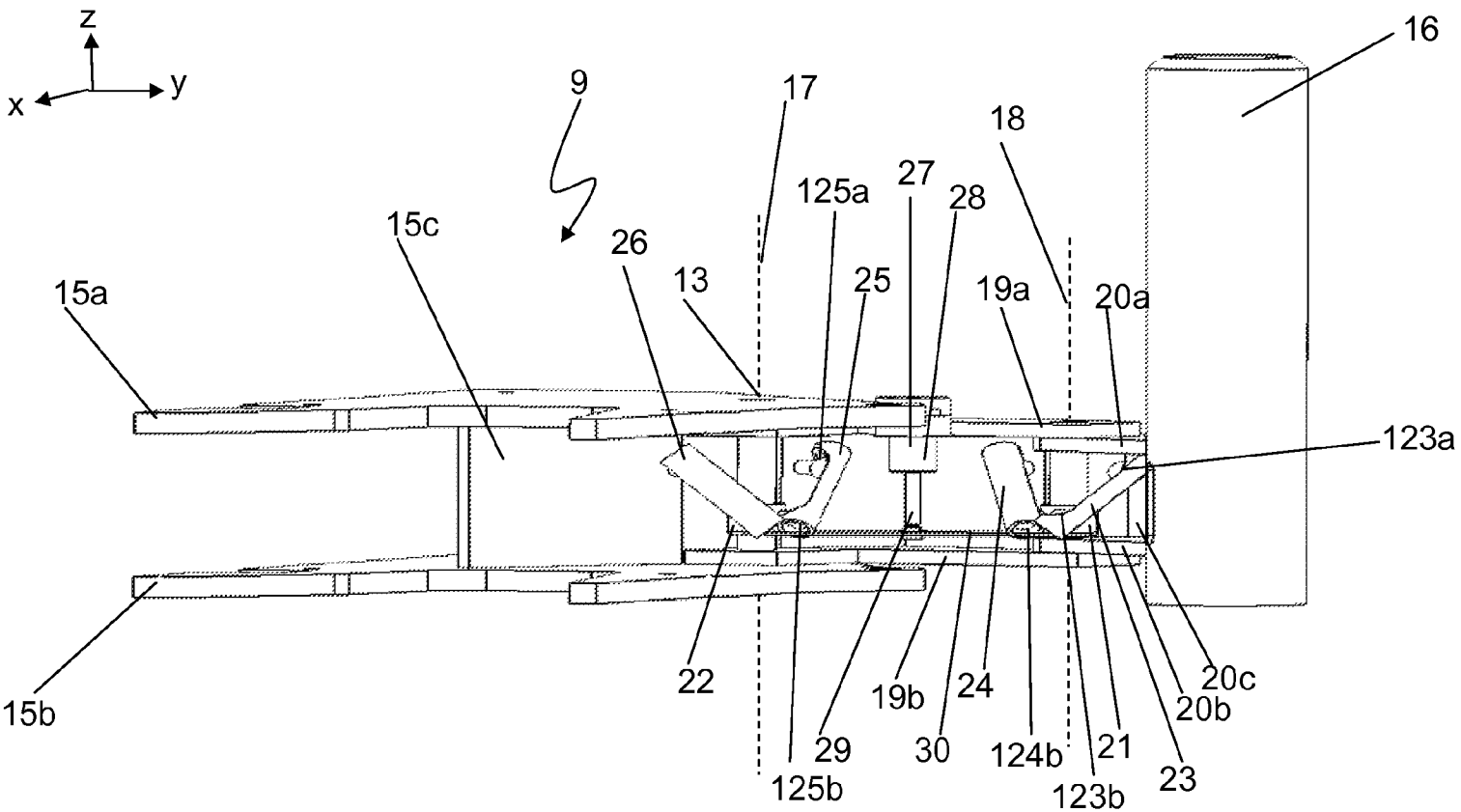
Figure 2D:
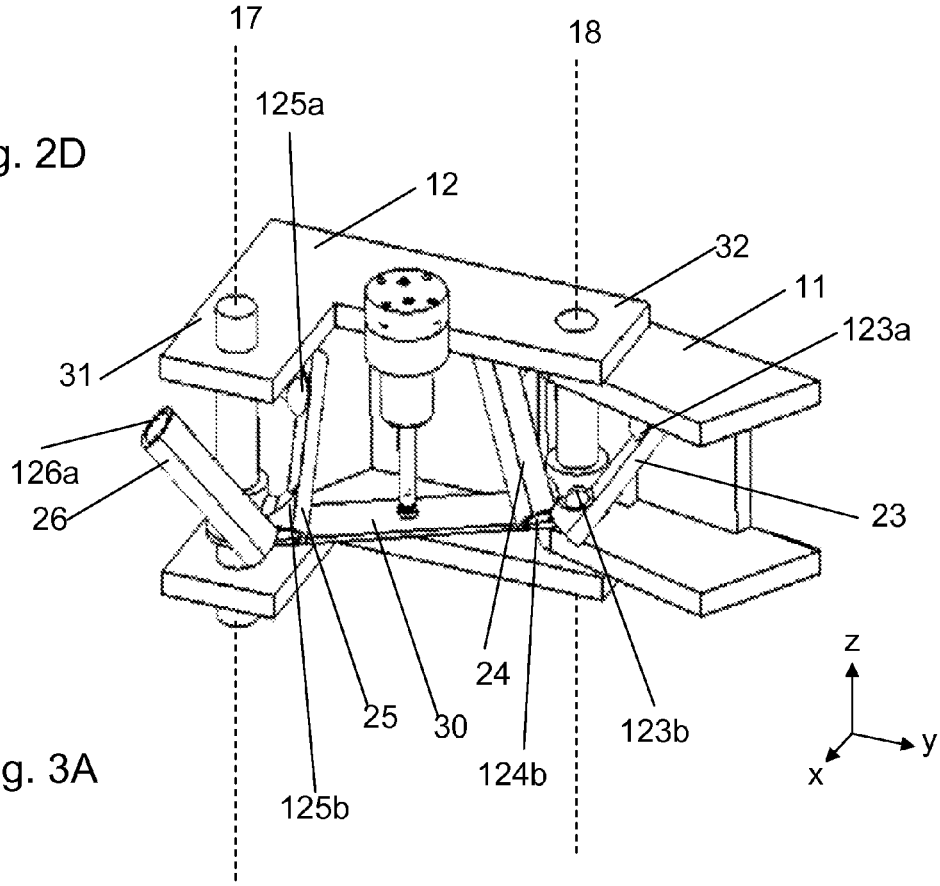
Figure 3A:
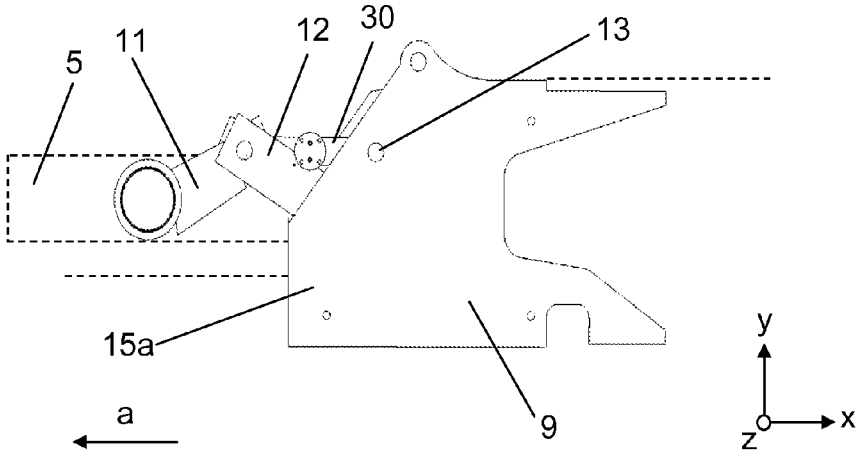
FIGS. 3A to 3C show various views of the pivot unit in the "inwardly pivoted position" according to an embodiment of the present invention.
Figure 3B:
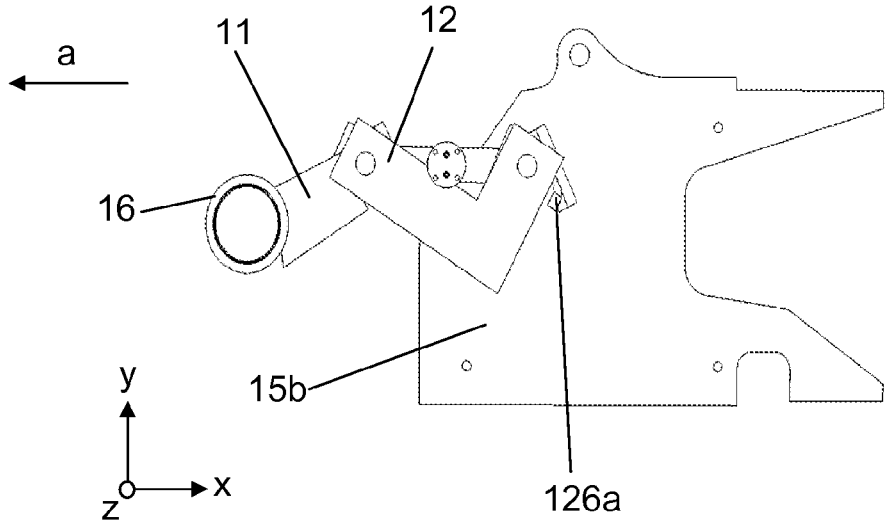
Figure 3C:
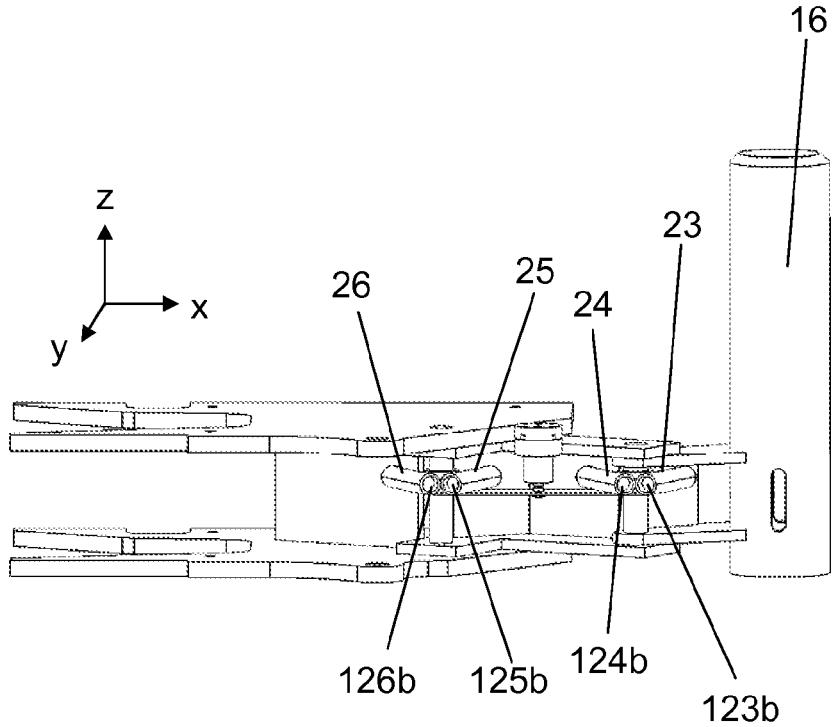
Figure 4A:
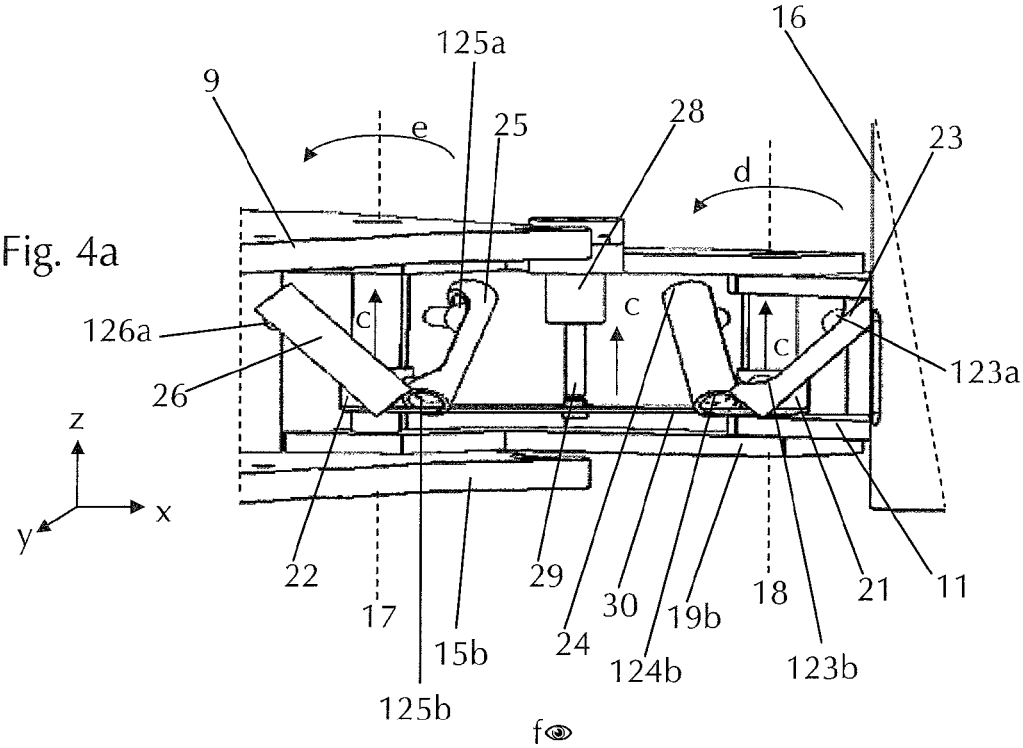
FIGS. 4A and 4B show a sectional enlargement of the deflection unit in the "outwardly pivoted position" (FIG. 4*a*) and in the "inwardly pivoted position" (FIG. 4*b*) according to an embodiment of the present invention.
Figure 4B:
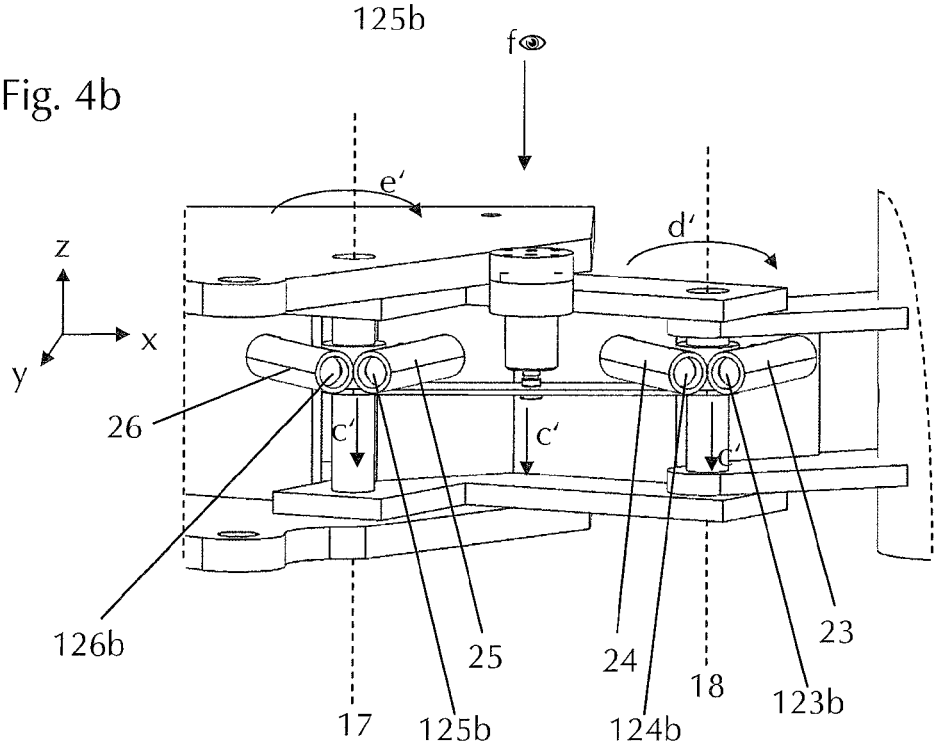

FIGS. 2*a* to 2*d* and 4*a* provide details of the swivel unit in the "outwardly pivoted position" 5*a* and the FIGS. 3*a* to 3*c* and 4*b* in the "inwardly pivoted position" 5*b*. FIGS. 2*a*, 2*b*, 3*a*, 3*b* concern top views, with the upper base plate 15*a* being removed in the FIGS. 2*b* and 3*b* in relationship to the FIGS. 2*a* and 3*a*, so that the view on the swivel arm 10 is provided. FIGS. 2*c* and 3*c* are perspective oblique views and FIG. 2*d* shows the swivel arm 10 with respective gear parts. FIG. 4*a* shows an enlarged sectional view of a partial area of the pivot gear of FIG. 2*b* and FIG. 4*b* shows an enlarged sectional view of a partial area of the pivot gear of FIG. 3*c*.

The fundamental configuration of the pivot gear will be explained at first. For reasons of clarity, reference is hereby made to the entirety of FIGS. 2*a* to 4*b* and reference is not repeated for each element in each individual drawing.

The swivel unit 8 comprises at first an articulation area 9 which is formed by the machine frame and a swivel arm 10. The swivel arm 10 is horizontally swivelable (in the x/y plane) and linked via a suitable link joint 13 to the articulation area 9 on the side of the machine frame. The link joint 13 (and also the link joint 14 that will be mentioned below) each comprise a link pin whose longitudinal axis extends in the vertical direction and is coaxial to the swivel axis 17 or 18. For reasons of clarity, no differentiation will be made between the swivel axis 17 and 18 and the link pin extending coaxially to the swivel axis 17 and 18. The articulation area 9 is thus a part of the machine frame, the further progression of which is indicated by way of example in FIGS. 2*a* and 3*a* by the two broken lines. The articulation area 9 specifically comprises the area of the machine frame which encloses the link joint 13, as is indicated in FIG. 2*a* with the dotted area. The articulation area 9 especially also comprises the part of the machine frame to which the deflection device is linked which will be explained below in closer detail. The articulation area 9 thus comprises at least the part of the machine frame on which the link joint 13 to the swivel arm 10 is mounted and the part of the machine frame to which the deflection device is linked on the side of the machine frame.

In the embodiment of the swivel unit 8 as shown in FIGS. 2*a* to 4*b*, the swivel arm 10 is arranged with two members and comprises and outside arm 11 and an inside arm 12. The outside arm 11 is disposed on the outer free end of the swivel arm 10 and the inside arm 12 connects the outside arm 11 with the articulation area 9 on the machine frame side. The outside arm 11 comprises a wheel suspension (not shown in closer detail) on which the support wheel 5 is suspended, as illustrated in closer detail in FIG. 2 by the support wheel 5 shown with the broken line. The outside arm 11 is mounted in a horizontally pivotable manner relative to the inside arm 12. For this purpose, a link joint 14 is provided which specifically concerns a vertically extending link pin which is guided through the outside arm 11 and through the inside arm 12. The link pin also extends coaxially to the respective swivel axis 18 of the link joint 14. The inside arm 12 is linked in a horizontally pivotable manner to the articulation area 9 of the machine frame with the link joint 13.

Further details on the principal configuration of the pivot gear of the illustrated embodiment are especially also shown in the perspective oblique view of FIG. 2*c*. The direction of view for illustrating the swivel unit 8 in FIG. 2*c* is indicated in FIG. 2*a* with the arrow b. The articulation area 9 comprises two horizontal base plates 15*a* and 15*b* which are connected with each other via an intermediate plate 15*c*. This articulation area, which comprises the base plates 15*a* and 15*b* and the intermediate plate 15*c*, is rigidly connected with the remaining machine frame of the road building machine 1 and thus also forms a part of the machine frame. The swivel arm 10 is adjacent to the articulation area 9 with its outside arm 11 and the inside arm 12. The outside arm 11 carries a merely indicated wheel suspension 16, with the rear support wheel 5 (only shown with a broken line in FIG. 2*a*) being arranged at its bottom end.

The inside arm 12 is pivotably held (x/y plane) on the pivot area by means of the link joint 13. The link joint 13 ensures that the inside arm 12 is held to be pivotable on the articulation area 9 around the rotational axis 17. A further link joint 14 connects the outside arm 11 in a pivotable manner with the inside arm 12. The swivel axis 17 of the link joint 13 and the swivel axis 18 of the link joint 14 each pass through a link pin of the respective link joint 13 and 14 and are disposed parallel with respect to each other. The inside arm 12 is enclosed in a fork-like manner by the overlapping part with the base plates 15*a* and 15*b* and also comprises an upper plate 19*a* and a bottom plate 19*b*. The two plates 19*a* and 19*b* of the inside arm 12 are also connected with one another via an intermediate plate 19*c*.

The outside arm 11 is fixedly arranged on the wheel suspension 16 on the one hand. It further comprises the plates 19*a* and 19*b* for connection with the inside arm, which plates are connected with each other via the intermediate plate 19*c*. In the region of the link joint 14, the plates 19*a* and 19*b* enclose the outside arm in the axial direction of the swivel axis 18 on both sides.

A relevant aspect of the invention lies in the arrangement of the pivot gear as a spatial gear, as will be described below in closer detail. In addition to the already mentioned gear elements, the pivot gear further comprises two annular slides 21 and 22, which are guided along the link pin between the articulation area 9 and the inside arm 12 as well as the inside arm 12 and the outside arm 11 in the vertical direction or along the swivel axis 17 and 18. One each of the link joints passes through the slides 21 and 22 in the vertical direction. A further element of the pivot gear is the thrust drive 27 which is held on the inside arm 12 and comprises a cylinder 28 and a piston 29. The cylinder 28 and the piston 29 form in their entirety a hydraulically actuatable cylinder/piston unit. The relevant aspect in the principal arrangement of the swivel unit according to the FIGS. 2*a* to 4*b* is further a connecting web 30 which connects the two slides 21 and 22 with each other and which is triggered by the piston 29 of thrust unit 27. The position of the thrust unit 27 is chosen in such a way that the piston 29 is centrically linked. In other words, the thrust drive 27 is thus arranged in the horizontal plane precisely between the two swivel axis 17 and 18, along which the slides 21 and 22 are displaceable. The thrust drive 27 is further connected to the hydraulic system of the road building machine 1, which is not shown in the drawings for reasons of simplicity of the illustration. Four rigid deflection members 23, 24, 25 and 26 are further present, the arrangement and function of which will be explained below in closer detail.

FIG. 2*a* shows the swivel unit 8 in a top view. Plate 15*a* has been removed in FIG. 2*b* in comparison with FIG. 2*a* and provides a view of the swivel arm 10 (the same applies to FIG. 3*b* in relationship to FIG. 3*a*).

The deflection members 23, 24, 25 and 26 are connected with their ends via link joints 123*a*, 123*b*, 124*a*, 124*b*, 125*a*, 125*b*, 126*a* and 126*b* (the numbering of the respective link joint is obtained from the number of the deflection member and a preceding 1; the "upper" link joint is designated with the letter "a" and the bottom one with "b") with the respective, functionally adjacent gear member. This is shown especially in FIGS. 2*c*, 2*d*, 3*c* and 4*a*. The reference numbers 123*a*, 123*b*, 124*a*, 124*b*, 125*a*, 125*b*, 126*a* and 126*b* each characterize a link joint and each comprise a joint socket and a ball head. The respective joint socket of each link joint of the deflection members 23, 24, 25 and 26 is formed on the respective deflection member, whereas the corresponding joint ball is arranged on the gear member such as the inside arm 12 for example which is linked by the deflection member 23, 24, 25 and 26. Only the visible link joints 123*a*, 123*b*, 124*a*, 124*b*, 125*a*, 125*b*, 126*a* and 126*b* are designated in the individual drawings. The interaction of the individually mentioned components will be explained below in closer detail.

An inward pivoting process shall be described at first in FIGS. 2*a* to 4*b* for closer explanation of the functionality of the pivot gear. The support wheel 5 is disposed at first in the "outwardly pivoted position" 5*a* and is pivoted inwardly to its "inwardly pivoted position" 5*b*. The starting point of this sequence of movements is thus the position of the pivot gear as shown in FIGS. 2*a* to 2*d* and in FIG. 4*a*. The end point of the pivoting movement is the position of the pivot gear as given in FIGS. 3*a* to 3*c* and in FIG. 4*b*. The principal sequence of movement of the deflection members 23, 24, 25 and 26 in particular in relation to the thrust drive 27 will be provided below by reference to a comparison of the positions of FIGS. 4*a* and 4*b*.

The drive of the inwardly pivoting movement occurs by retraction of the piston 29 in the direction of arrow c. The direction of arrow c extends vertically (in the z-direction) or orthogonally to the pivot plane (x/y plane) of the swivel arm 10. The two swivel axes 17 and 18 also extend vertically. The connecting web 30 is also moved in the direction of arrow c, which means upwardly in the vertical direction, by the "lifting movement" of the thrust unit 27 or the retraction of the piston 29 into the cylinder 28. The connecting web 30 is connected at its two ends with the slides 21 and 22 which are guided along the respective link pin of link joint 13 and 14. The connecting web 30 is rigidly arranged and thus transmits the movement of the thrust unit 27 to the two slides 21 and 22. By retracting the piston 29 into the cylinder 28, the slides 21 and 22 are displaced in the direction c (thus upwardly in Fig. A) via the connecting web 30. The two slides 21 and 22 each comprise two ball joint heads on the outer edge which are part of the ball-and-socket joints 123*b*, 124*b*, 125*b*, and 126*b* and produce an articulated connection of slides 21 and 22 with the respective deflection members 23, 24, 25 and 26. The ends of the deflection members 23, 24, 25 and 26 which are mounted on the slides 21 and 22 thus also move upwardly with the slides 21 and 22. As a result of the rigid arrangement of the deflection members 23, 24, 25 and 26, they press with their free ends opposite of the slides 21 and 22 against the outside arm 11 (deflection member 23), the inner arm 12 (deflection member 24 and 25) and the articulation area 9 (deflection member 26) in the inwardly pivoting direction. Only the horizontal component transmitted by the respective deflection member 23, 24, 25 and 26 comes to bear, which each alone enable a horizontal movement as a result of the arrangement of the two link joints 13 and 14 as described above. This deflection by the actuating force exerted by the thrust unit 27 in the vertical direction into a pivoting movement in the horizontal direction is thus substantially the result of the exclusively horizontal pivotability of the outside arm 11, the inside arm 12 and the articulation area 9, which thus represents a kind of forced guide. They are unable to follow the (also forcibly guided) vertical movement in the direction of arrow c. As a result, a vertical adjustment (in the z-direction) of the slides 21 and 22 in the direction of arrow c leads to a horizontal (in the x/y plane) inward pivoting of the swivel arm 10, with the outside arm 11 pivoting inwardly relative to the inside arm 12 in the direction of arrow d and the inside arm 12 relative to the articulation area 9 or the machine frame in the direction of arrow e. Conversely, a vertical adjustment of the slides 21 and 22 in the direction of arrow c' by an extension of the piston 29 from the cylinder unit 28 in the vertical direction downwardly leads to a horizontal outward pivoting movement of the swivel arm 10, with the outside arm 11 pivoting outwardly relative to the inside arm 12 in the direction of arrow d' and the inside arm 12 pivoting outwardly relative to the articulation area 9 or the machine frame in the direction of arrow e'.

Figure 5A:
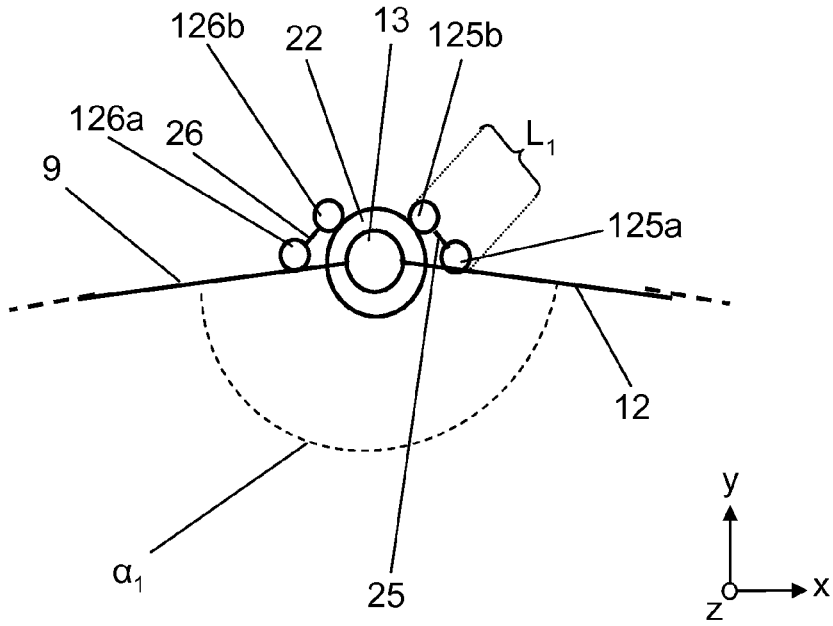
FIGS. 5A and 5B show a schematic diagram of a spatial joint in the horizontal plane in the "outwardly pivoted position" (FIG. 5*a*) and in the "inwardly pivoted position" (FIG. 5*b*) according to an embodiment of the present invention.
Figure 5B:
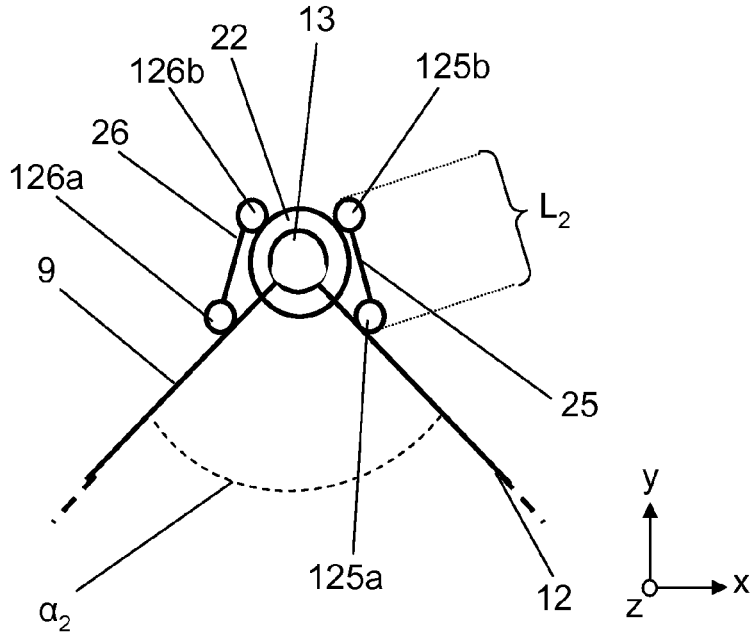

The principal functionality of this deflection of forces is schematically further illustrated in the schematic FIGS. 5*a* and 5*b*. They show a top view of the principal arrangement of a link joint, specifically shown by reference to the example of link joint 13 between the inside arm 12 and the articulation area 9, with merely the area adjacent to the link joint 13 being shown in FIGS. 5*a* and 5*b*. FIGS. 5*a* and 5*b* represent the sequence of movements in a top view along the swivel axis 17, i.e. the horizontal x/y plane. FIG. 5 shows the "outwardly pivoted position" 5*a* and FIG. 5*b* the "inwardly pivoted position" 5*b*. The angle α between the articulation area 9 and the inside arm 12 in the horizontal plane is stated with α1 to α2. If slide 22 is displaced along the swivel axis or along the link pin of the link joint 13 in the vertical direction, which specifically means a displacement starting from FIG. 5*a* towards the viewer in FIG. 5*b*, then this will lead to a relative change in length of the deflection members 25 and 26 in the horizontal plane which is characterized by L1 and L2. This relative change in length in the horizontal plane triggered by the vertical movement of the slide 22 finally represents a relevant aspect of the deflection device.

Figure 6A:
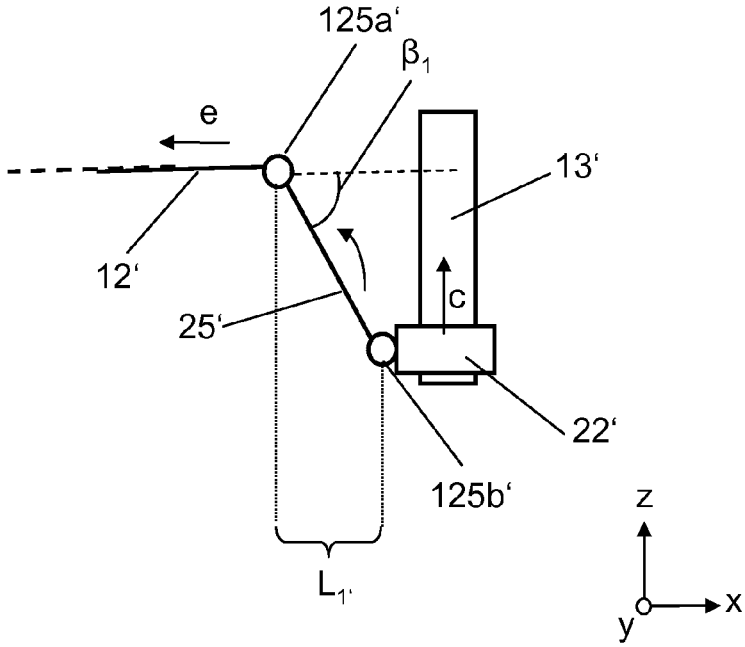
FIGS. 6A and 6B show a schematic diagram on the functionality of the deflection device according to an embodiment of the present invention.
Figure 6B:
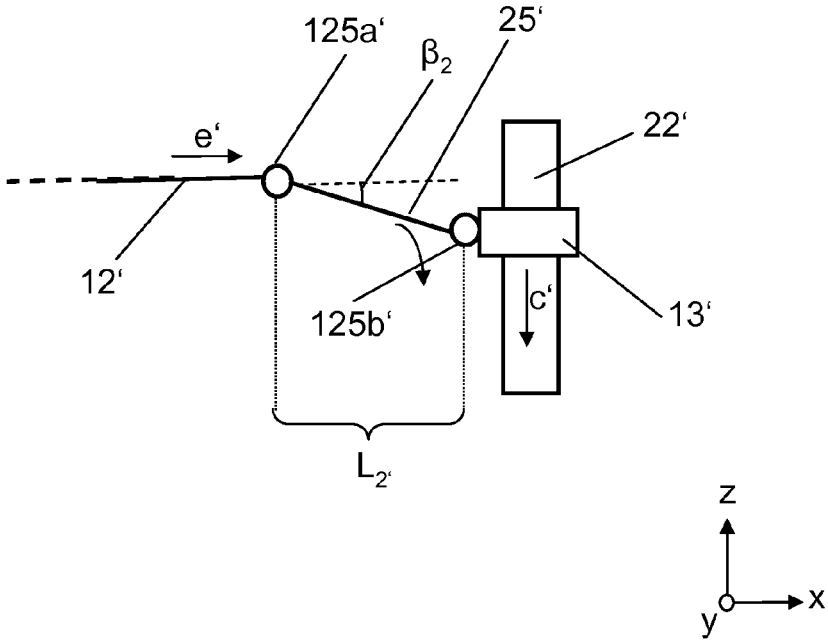

Reference is hereby made to FIGS. 6*a* and 6*b* to illustrate in closer detail the principal function of this deflection of a vertical movement to a horizontal movement. FIGS. 6*a* and 6*b* provide a sketch of the sequence of movement of the respective gear members in FIGS. 5*a* and 5*b*, with a concrete illustration of the pivoting movements being omitted in FIGS. 6*a* and 6*b* for reasons of clarity. In contrast to the pivot gear in accordance with the invention, the outside arm 11' is thus not pivoted in the x/y plane, but is merely displaced linearly in the x/y plane to the outside. The outside arm 11' is thus held in a linearly guided manner and is not pivotably held in the horizontal plane. The corresponding reference numerals are also labeled with a prime (') as a result of this difference. It is clear from FIG. 6*a* that an adjustment of the slide 22' in the direction of arrow c reduces the position angle of the longitudinal axis of the deflection member 25' relative to the horizontal plane (broken line) or approaches 0°. The length of the deflection member 25' in the horizontal plane increases from L1' to L2'. As a result of this relative change in length of the length of the deflection member 25' which is projected into the horizontal plane (or specifically the distance length between the two link joints 125*a*' and 125*b*'), the forcibly guided inside arm 12' is displaced to the outside. If the movement of the slide 22' is reversed, the individual parts will move in the direction of arrows as shown in FIG. 6*b*.

The pivot gear of the invention now goes beyond the principal configuration as shown in FIGS. 6*a* and 6*b* in the respect that the inside arm 12' is not mounted in a linearly displaceable manner in the horizontal plane, but it is pivotable, e.g. by articulation of the inside arm 12 on the link joint 13. In contrast to the linear forced guide, a pivoting forced guide is thus obtained which is used for inward and outward pivoting of the support wheel which is disposed on the null side. Applied to FIGS. 5*a* and 5*b* this means that the vertical movement of slide 22 along the link joint out of the image plane will lead to a relative change in length L1 L2 of FIG. 5*a* to FIG. 5*b*, so that the two limbs 12 and 9 are moved towards one another as a result (according to the stated angles α1 and α2).

A further relevant aspect that is obtained from the drawings is the relative positional arrangement of the ball-and-socket joints 123*b*, 124*b*, 125*b* and 126*b* on the respectively associated slide 21 and 22. In the case of a projection into the horizontal pivoting plane, the ball joint is disposed adjacent to the swivel axis 17 and 18 or eccentrically in relation to the swivel axis. As a result, the respective deflection member 23, 24, 25 or 26 can transmit the required power in the pivoting direction onto the inside arm 12 or outside arm 13 to be swiveled.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A road building machine for road surface paving, comprising:

an automotive travelling mechanism with a steerable front axle of the undercarriage comprising at least one support wheel and two rear support wheels;

a working device which is mounted in or on the machine frame and is approximately flush with said machine frame on one side, said one side being a null side;

a swivel unit having an articulation area formed by the machine frame and a swivel arm which carries the rear support wheel on the null side at its one end and is pivotably linked at its other end to the articulation area of the machine frame, with the swivel unit being arranged in the manner that it can be pivoted between an "outwardly pivoted position" in which the rear wheel which is on the null side is pivoted outwardly to an outer end position parallel to the longitudinal direction of the machine frame and an "inwardly pivoted position" in which the rear support wheel which is on the null side is inwardly pivoted to a parallel inward end position which is parallel to the longitudinal direction of the machine frame; and a pivot gear which controls the adjustment of the swivel unit between the "outwardly pivoted position" and the "inwardly pivoted position" around a swivel axis, wherein the pivot gear is a spatial gear, with a thrust member which is adjustable in the vertical direction, that comprises a deflection device which is arranged in a manner such that the deflection device deflects the vertical movement of the thrust member to a horizontal inwardly and outwardly pivoting movement of the swivel arm.

2. A road building machine according to claim 1, wherein the spatial gear is a coupling gear.

3. A road building machine according to claim 1, wherein the thrust member comprises a slide which is guided along a vertically-extending thrust axis and the deflection device is arranged between the slide and the swivel arm.

4. A road building machine according to claim 3, wherein the deflection device is a rigid deflection member which is linked to the slide via a first link joint and is linked to the swivel unit via a second link joint, with the longitudinal axis between the two link joints being disposed at an angle (β) of 0° to less than 90° relative to the horizontal pivot plane of the swivel arm.

5. A road building machine according to claim 1, wherein the thrust axis of the thrust member and the swivel axis of the swivel arm are arranged coaxially.

6. A road building machine according to claim 1, wherein the deflection device comprises a further deflection member which is linked to the thrust member, with the one deflection member being linked with its free end to the articulation area on the side of the machine frame and the other deflection member with its free end to the swivel arm.

7. A road building machine according to claim 6, wherein the two deflection members are structurally identical.

8. A road building machine according to claim 1, wherein the swivel arm is arranged with at least two members and comprises an inside arm and an outside arm, with the inside arm being horizontally pivotable relative to the articulation area on the side of the machine frame and the outside arm horizontally pivotable relative to the inside arm.

9. A road building machine according to claim 8, wherein the spatial gear comprises a further deflection device which deflects the vertical movement of the thrust member into a horizontal pivoting of the outside arm relative to the inside arm.

10. A road building machine according to claim 9, wherein the further deflection device comprises a slide, the thrust axis of which extends coaxially to the swivel axis between inside arm and outside arm.

11. A road building machine according to claim 10, wherein the thrust axes of the slides and the swivel axes of the swivel device extend parallel with respect to each other.

12. A road building machine according to claim 10, wherein both slides are functionally coupled with each other.

13. A road building machine according to claim 12, wherein a connecting web is provided for functional coupling between the two slides.

14. A road building machine according to claim 10, wherein the slides are triggered by a joint thrust drive.

15. A road building machine according to claim 8, wherein the thrust drive is mounted on the inside arm.

16. A road building machine according to claim 8, wherein the inside arm is arranged in an L-shaped manner, with the shorter limb of the L-shaped inside arm being linked to the articulation area on the side of the machine frame and the longer limb on the outside arm.

17. A road building machine according to claim 1, wherein the link joints of the deflection device comprise ball-and-socket joints and the at least one deflection member comprises respective ball sockets.

18. A road building machine according to claim 17, wherein the link joints of at least one gear member comprise ball joints.

* * * * *